US009206656B2

(12) United States Patent
Roodenburg et al.

(10) Patent No.: US 9,206,656 B2
(45) Date of Patent: Dec. 8, 2015

(54) TUBULARS STORAGE DEVICE

(71) Applicant: ITREC B.V., Schiedam (NL)

(72) Inventors: Joop Roodenburg, Delft (NL); Xander Knobben, Rotterdam (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/386,398

(22) PCT Filed: Mar. 15, 2013

(86) PCT No.: PCT/NL2013/050183
§ 371 (c)(1),
(2) Date: Sep. 19, 2014

(87) PCT Pub. No.: WO2013/141697
PCT Pub. Date: Sep. 26, 2013

(65) Prior Publication Data

US 2015/0048038 A1 Feb. 19, 2015

Related U.S. Application Data

(60) Provisional application No. 61/613,285, filed on Mar. 20, 2012.

(51) Int. Cl.
*E21B 19/14* (2006.01)
*A47F 7/00* (2006.01)

(52) U.S. Cl.
CPC ..... *E21B 19/14* (2013.01); *A47F 7/0028* (2013.01)

(58) Field of Classification Search
CPC ..... E21B 19/14; E21B 19/15; E21B 19/155; A47F 7/0021; A47F 7/0028
USPC ..... 211/70.4
See application file for complete search history.

(56) References Cited

U.S. PATENT DOCUMENTS

| | | | | | |
|---|---|---|---|---|---|
| 1,718,395 | A | * | 6/1929 | Webb et al. | 211/70.4 |
| 1,887,901 | A | * | 11/1932 | Dodson | 211/70.4 |
| 1,947,553 | A | * | 2/1934 | Johnston | 211/70.4 |
| 2,094,506 | A | * | 9/1937 | Umphres | 211/70.4 |

(Continued)

FOREIGN PATENT DOCUMENTS

| | | | | |
|---|---|---|---|---|
| DE | 10023100 C1 | * | 9/2001 | E21B 19/15 |
| EP | 2 232 000 B1 | | 5/2011 | |

(Continued)

*Primary Examiner* — Stanton L Krycinski
(74) *Attorney, Agent, or Firm* — Birch, Stewart, Kolasch & Birch, LLP

(57) ABSTRACT

The invention relates to a tubulars storage device (1) for storing a plurality of tubulars (2*a-e*), said tubulars storage device comprising spaced apart fingers (3, 4) forming therebetween a slot (5), and a plurality of pivotably mounted latch members (9*a-e*) arranged at spaced apart locations along the slot (5). A rotary camshaft (11) is provided for pivoting the latch members (9*a-e*) between a closed position and an opened position. A drive (12) is provided for driving the rotary cam shaft (11) and thus pivot the latches (9*a-e*), one after the other, from their closed position into their opened position. In a final angular position of the cam shaft, all latch members (9*a-e*) are retained, preferably by opening cams, in their opened position, and are thus all effectively locked in this position, located out of the path of displacement of tubulars (2*a-e*), thereby allowing displacement of the tubulars along the slot (5).

20 Claims, 7 Drawing Sheets

(56) References Cited

U.S. PATENT DOCUMENTS

| | | | | | |
|---|---|---|---|---|---|
| 2,148,058 | A | * | 2/1939 | Clark | 211/70.4 |
| 2,311,933 | A | * | 2/1943 | Deckard | 211/70.4 |
| 2,507,040 | A | * | 5/1950 | Moore | 211/70.4 |
| 2,773,605 | A | * | 12/1956 | De Jarnett | 414/22.71 |
| 3,193,084 | A | * | 7/1965 | Bauer et al. | 414/746.4 |
| 3,501,017 | A | * | 3/1970 | Johnson et al. | 211/70.4 |
| 3,561,811 | A | * | 2/1971 | Turner, Jr. | 294/90 |
| 3,592,347 | A | * | 7/1971 | Kelly et al. | 414/22.71 |
| 3,612,286 | A | * | 10/1971 | Langowski et al. | 211/70.4 |
| 3,615,027 | A | * | 10/1971 | Ham | 14/22.71 |
| 3,616,941 | A | * | 11/1971 | Walling | 414/746.2 |
| 3,768,663 | A | | 10/1973 | Turner, Jr. et al. | |
| 3,799,364 | A | | 3/1974 | Kelly et al. | |
| 3,870,165 | A | * | 3/1975 | Besijn | 414/22.71 |
| 4,632,618 | A | | 12/1986 | Issakainen | |
| 6,089,333 | A | * | 7/2000 | Rise | 175/85 |
| 7,083,007 | B2 | * | 8/2006 | Herst | 175/52 |
| 7,510,028 | B2 | * | 3/2009 | Welsh | 175/52 |
| 8,631,949 | B2 | * | 1/2014 | Roodenburg et al. | 211/60.1 |
| 9,016,382 | B2 | * | 4/2015 | Braxton | 166/352 |
| 2009/0053015 | A1 | * | 2/2009 | Zachariasen et al. | 414/22.66 |
| 2011/0005162 | A1 | * | 1/2011 | Roodenburg et al. | 52/651.05 |

FOREIGN PATENT DOCUMENTS

| | | |
|---|---|---|
| GB | 1214346 | 12/1970 |
| WO | WO 2005/061839 A1 | 7/2005 |

* cited by examiner

TUBULARS STORAGE DEVICE

CROSS REFERENCE TO RELATED APPLICATIONS

This application is the National Phase of PCT International Application No. PCT/NL2013/050183, filed on Mar. 15, 2013, which claims priority under 35 U.S.C. 119(e) to U.S. Provisional Application No. 61/613,285, filed on Mar. 20, 2012, all of which are hereby expressly incorporated by reference into the present application.

The present invention relates to a tubulars storage device for storing a plurality of tubulars. In the oil and gas well drilling industry numerous types of piping, referred to generally as "tubulars", are used. Tubulars include drill pipes, casing pipes, and other connectable (e.g. by screwthread) oil and gas well structures. Long "strings" of joined tubulars, e.g. drill strings or casing strands, are typically used to drill a wellbore and to prevent collapse of the wellbore after drilling.

A common tubular storage device for tubulars in the oil and gas industry is referred to as "a fingerboard". Other known storage devices for tubulars in the oil and gas industry are referred to as "setbacks", "setback drums", "pipe racks", "pipe rackers", etc.

BACKGROUND OF THE INVENTION

Tubulars storage devices, such as fingerboards, typically include a slot delimiting structure, e.g. spaced apart finger members, that define a slot capable of receiving a plurality of tubulars, e.g. drill strings. Each tubular is typically individually secured at a storage position along the slot by a corresponding latch member, which is movable between a opened and an closed position.

In some prior art tubulars storage devices, the latches are manually moved between the opened and closed positions by a worker who walks across the fingers to manually move the latches, e.g. by kicking, to the desired closed or opened position. As the finger members are often mounted at a great height (in some instances 90 feet above the drilling floor or taller) this type of manual operation of the latches by the worker is dangerous.

To overcome this dangerous situation tubular storage devices have been developed that include "automated latches" which are controlled from a remote location.

In U.S. Pat. No. 3,768,663 and U.S. Pat. No. 3,799,364 tubular storage device for use in a drilling rig are shown, wherein pivotal latch fingers are placed along the storage slot. The fingers are each connected to a hydraulic cylinder in order to selectively bring the latch into a closed position, wherein the finger extends into the path of displacement of the tubulars formed by the slot, and an opened position, wherein the finger is out of said path of displacement.

In WO 2005/061 839 an alternative storage device is shown. This device includes a so-called row controller that is connected to each of the latches for individually and sequentially moving the latches between the closed and the opened position.

In EP 2 232 000 a more recent tubular storage device is shown. This device includes a slot for storing tubulars, and a plurality of, substantially disc shaped, latch members mounted on a rotary latch members shaft. The disc shaped latch members are positioned such that they bridge the slot and thus block movement of tubulars along the slot. The disc shaped latch members are furthermore provided with recesses in their circumference. By rotating the latch member shaft, the disc shaped latch members are rotated and their recessed sections can be positioned one after the other in the slot to allow movement of a tubular along the slot. The extension thus prevent movement of the tubulars along the slot. It is noted that all latch members are rotated when the latch member shaft is rotated.

OBJECT OF THE INVENTION

It is an object of this invention to provide an alternative tubular storage device that preferably is better suited to the needs of the oil and gas industry than prior art devices.

SUMMARY OF THE INVENTION

The present invention provides a tubulars storage device for storing a plurality of tubulars. The tubulars storage device comprises a slot, a plurality of latch members, a rotary camshaft, a plurality of opening cams and a drive.

The slot is defined by spaced apart finger members, the slot having an opening at a front end thereof. This storage slot forms a path of displacement for tubulars allowing to place tubulars at respective storage positions distributed along the slot as well as removal of said tubulars from the slot.

The plurality of latch members are arranged at spaced apart locations along the slot so as to be effective between said storage positions of the tubulars. The latch members are each mounted pivotably on a pivot axis mounted substantially parallel to the slot, such that they can each be pivoted between a closed position and an opened position. In their closed position, the latch members each extend in the path of displacement of the tubulars along the slot, thereby prohibiting displacement of the tubulars along the slot. The latch members are each provided with a first cam follower.

The rotary camshaft is adapted for actuation of pivoting motion of the latch members. The camshaft is mounted substantially parallel to the slot.

The drive is connected to the rotary camshaft, and is adapted to effect controlled angular rotation of the camshaft.

The plurality of opening cams are mounted on the camshaft so as to rotate with the camshaft. The plurality of opening cams are arranged at spaced apart locations along the camshaft so as to each interact with the first cam follower of an associated latch member. Each opening cam has an angular opening extension that, when the drive drives the camshaft in a main direction, causes the associated latch member to move to its opened position and preferably retains said latch member in its opened position.

The plurality of opening cams include a front opening cam having a largest angular opening extension and a rear opening cam having a smallest angular opening extension as well as one or more intermediate opening cams between said front and rear opening cam. Each of the intermediate opening cams has a smaller angular opening extension than the preceding opening cam, front to back, on the camshaft. Thus, the fingers are opened one after the other by driving the camshaft.

The drive is adapted to selectively bring the camshaft in one of a number of distinct angular positions, said number corresponding to the number of opening cams on the latch member shaft plus one.

The angular opening extension of each of the opening cams on the camshaft is chosen such that:

in a first angular position of the camshaft all latch members are in their closed position, extending in the path of displacement of tubulars, thereby prohibiting displacement of the tubulars along the slot, when the camshaft is driven in the main direction from the first angular position into a second angular position only the front latch member is moved by the front opening cam out of said path of displacement of the tubulars and into its opened position, thereby allowing the passage of a tubular, when the cam shaft is driven in the main direction into each subsequent angular position, said front latch member is retained, preferably by the front opening cam, in its opened position, and a successive latch member is also moved out of said path of displacement of the tubulars and into its opened position by a successive opening cam, thereby allowing the passage of a tubular, and in a final angular position of the camshaft all latch members are retained, preferably by the opening cams, in their opened position, and are thus all effectively locked in this position, located out of the path of displacement of tubulars, thereby allowing displacement of the tubulars along the slot.

The invention thus provides an alternative tubulars storage device for storing a plurality of tubulars.

The use of a camshaft for actuating the latch members allows for a compact and reliable tubulars storage device. Thus, by providing a tubulars storage device comprising cam operated latches, the invention provides an alternative tubular storage device that is better suited to the needs of the oil and gas industry than prior art devices.

The latches of the tubulars storage device are driven by a rotary camshaft. The camshaft is provided with cams for, by cooperating with the first cam follower of the latches, opening the latches one by one. Thus, the rotary camshaft interacts with multiple latches, and one drive can be used for opening and closing multiple latches. Furthermore, the latches are moved separately into their opened position, i.e. one after the other. The drive thus only moves one latch at the time when the rotary camshaft is rotated, the load on the drive is therefore limited and thus a compact drive can be used.

Moving only one latch at a time is in particular advantageous because the stored tubulars may lean against the latches. In such a situation the load on the drive when opening a latch is increased due to the friction between the tubular and the latch moving along the tubular. However, with a tubular storage device according to the invention, the drive moves one latch at a time, thus the increase in load is restricted to the friction between one latch and one tubular only.

The tubular storage device according to the invention thus provides a single drive operating multiple latches individually, i.e. one at a time. The invention thus provides a storage device with an improved drive system for opening and closing of the latches.

Furthermore, because the latches are moved one after the other for releasing the tubulars, a single, comparatively small drive can be used. Also, because only one drive is needed for moving all latches, the invention provides a tubular storage device that requires little maintenance.

Furthermore, by combining a drive with a cams shaft, the drive can be positioned at a distance from stored tubulars, for example in a structure supporting the finger members, and can be shielded form the slot formed between those fingers.

In an embodiment of a storage device according to the invention the angular opening extension of the opening cams, associated with the first cam follower of a latch, have a constant radius flank for retaining an opened latch in the opened position while the camshaft rotates in the main direction to open the subsequent latches. Thus, without the need of extra devices, the latch is locked in the opened position and prevented from moving into the closed position by accident and blocking the movement of a tubular released by a subsequent latch.

In an alternative embodiment, for example a gripper is provided to retain the latch in the opened position.

An embodiment of a storage device according to the invention comprises a second cam follower on each latch member and a plurality of closing cams. The plurality of closing cams are mounted on the camshaft so as to rotate with the camshaft, and are arranged at spaced apart locations along the camshaft so as to each interact with the second cam follower of an associated latch member.

Each closing cam has an angular closing extension that, when the drive drives the camshaft in a counter direction, i.e. opposite to the main direction, causes the associated latch member to move to its closed position and preferably retains said latch member in its closed position.

The plurality of closing cams includes a front closing cam having a smallest angular closing extension and a rear closing cam having a largest angular closing extension as well as one or more intermediate closing cams between said front and rear closing cam. Each of the intermediate closing cams, front to back, has a greater angular closing extension than the preceding closing cam on the camshaft.

The angular closing extension of each of the closing cams on the camshaft is chosen such that:

when the camshaft is driven in the counter direction from the final angular position into the preceding angular position, only the back latch member is released, preferably by the back opening cam, and is moved by the back closing cam into said path of displacement of the tubulars and into its closed position, moving it into its closed position, blocking the passage of a tubular, when the camshaft is driven in the counter direction into each preceding angular position, said back latch member is retained in its closed position, preferably by an associated locking cam, and a preceding latch member is released, preferably by a preceding opening cam, and moved into said path of displacement of the tubulars and out of its closed position by a preceding closing cam, moving it into its closed position, blocking the passage of a tubular, and in the first position of the camshaft all latch members are retained in their closed position, preferably by the closing cams, and are thus all effectively locked in this position, extending in the path of displacement of tubulars, thereby prohibiting displacement of the tubulars along the slot.

Thus, by driving the camshaft in the main direction, the latches are opened one after the other, and by subsequently rotating the shaft in the counter direction, the latches are closed one after the other. The latch that was opened last will be closed first, and the latch that was opened first will be closed last.

By providing this tubular storage device according to the invention with closing cams, the movement of the latches from their opened to their closed position as well as from their closed towards their opened position is fully controlled by the drive.

In an alternative embodiment, the latches are, when the camshaft is driven in the counter direction, pivoted from their opened position into their closed position by gravity and/or by resilient bodies, such as spring or hydraulic cylinders. Other closing device can also be provided.

In an embodiment of a storage device according to the invention, the angular closing extension of the closing cams, associated with the second cam follower of a latch, have a constant radius flank for retaining a closed latch in the closed position while the camshaft rotates in the counter direction to close the subsequent latches.

Thus, without the need of extra devices, the latch is locked in the closed position and prevented from moving into the closed position by accident and blocking the movement of a tubular released by a subsequent latch.

In a further embodiment, the opening cams are designed to pivot the latches into their opened position and retain or lock the latch in their opened position, and the closing cams are designed to pivot the latches into their closed position and retain or lock the latches in their closed position while preceding. Thus, by simply driving the rotary camshaft, latches are released, pivoted and retained or locked in their new position. For example, when the camshaft is driven in the main direction from a second to a third angular position, a second latch member is released by a second closing cam, engaged by a second opening cam and pivoted by that opening cam into its opened position, and retained by the opening cam in its opened position. During the cam shaft rotating from the second to the third angular position, the first latch member is retained in its opened position by the first opening cam, while the other latch members are retained in their closed position by their associated closing cams. In an alternative embodiment, for example a gripper is provided to retain the latch in the opened position.

It is noted that when a latch is retained in a position by a cam, the flank of that cam extends near, or is in contact with, the associated cam follower of that latch while the camshaft is rotated to prevent substantial movement of the associated cam follower, and thus of the latch member. For example, when an opening cam retains a latch member in its opened position, it prevents the cam from pivoting towards its closed position. In addition, a stop can be provided for preventing the latch member from pivoting further in the opposite direction, i.e. beyond the opened position. In such an embodiment, the latch is locked inbetween the opening cam and the stop.

When a latch is released, the guide surface of the cam that retained the latch member, moves away from the associated cam follower, and thus allows movement of the latch member. For example, when an opening cam releases a latch member from its opened position, the flank of the opening cam moves away by rotation of the cam shaft such that the latch member can be moved towards its closed position, for example by a closing cam.

In an embodiment of a storage device according to the invention the closing cam and the opening cam, associated respectively with the first cam follower and the second cam follower of a latch, each have flanks for guiding the cam followers. The flanks are formed such that each latch is with its cam followers enclosed between the flank of the opening cam and the flank of the closing, i.e. the flank of the opening cam prevents movement of the latch towards its opened position and the flank of the closing cam prevents movement of the cam towards its closed position. Thus, the cam is locked inbetween the two cams and no, or only limited, free movement of the latch is possible at any given position of the camshaft.

In an embodiment of a storage device according to the invention, the cams are shaped such that, when the camshaft is driven in the main direction from the final angular position into the first angular position, all latch member are simultaneously released by the opening cams and are moved, preferably by the closing cams, into their closed position. Thus, the tubular storage device is provided with the ability to quickly move all latches from their opened position into their closed position. Such an embodiment is in particular useful when the tubular storage device is provided with stacks of tubulars, such that tubulars for all storage positions are inserted into the slot, at mutual distances allowing the latches to be inserted between the tubulars, in one action.

In an embodiment of a storage device according to the invention, the cams are shaped such that, when the camshaft is driven in the counter direction from the first angular position into the final angular position, all latch member are simultaneously moved by the opening cams into their opened position. Thus, the tubular storage device is provided with the ability to quickly move all latches from their closed position into their opened position.

In an embodiment of a storage device according to the invention, the first cam follower and the second cam follower, associated with an opening cam and a closing cam respectively, of each latch member are located on opposite lateral sides of the respective latch member. Thus the cams can extend along the sides of the latch, which provides for a compact design which is advantageous on a drilling vessel where space is limited.

In an alternative embodiment, the latch is pivotably mounted with one end for blocking the latches and an opposite end for engaging one or more cams.

Preferably, the latch is provided with a central pivot axis mounted between the two laterally placed cam followers.

In an embodiment of a storage device according to the invention, the first cam follower and the second cam follower, associated with an opening cam and a closing cam respectively, of each latch member are located on opposite sides of the pivot axis supporting the respective latch member, such that when the first cam follower is moved in a downward direction, the second cam follower moves in an upward direction and visa versa. This configuration, especially in combination with the cam followers provided on the lateral sides of the latch, allows for a compact design.

In an embodiment of a storage device according to the invention, the cam followers are cylindrical shaped, preferably pivotably mounted, extensions.

In an embodiment of a storage device according to the invention, the latches, when in their closed position, extend fully across the fingerboard slot. Preferably, on the opposite side of the slot, latch receiving members are provided for receiving a distal end of the latch. The latch receiving member can for example be a U-shaped recess for receiving the end section latch member therein, or be a pin that engages a hole in the end section of the latch member. Thus, the latch, when in its closed position, is supported on both sides of the slot which allows for a more robust support of tubulars by the latch when in its closed position. Furthermore, when engaged by a latch receiving member, the latch is provided with a support to further secure the latch against movement in the horizontal plane, in particular along the slot.

In an embodiment according to the invention, the camshaft needs to be pivoted over an angle between 45 and 75 degrees, preferably over an angle between 50 and 70 degrees, more preferably over an angle of about 60 degrees, for pivoting a latch over an angle of about 90 degrees, for example an angle between 80 and 96 degrees, from the opened position into the closed position and visa versa. This allows for manipulating multiple latches, preferably about five, with one camshaft while keeping the load on the cams, while pivoting a latch, limited In an embodiment of a storage device according to the invention two latch mechanisms, each comprising latch members with associated camshaft and a latch support structure, are provided, which latch mechanisms are mounted at opposite sides of the storage slot. In a further embodiment of a storage device according to the invention, the two latch mechanisms are arranged to be active for the same tubular storage positions, such that a tubular, when locked in a storage position, is blocked by a latch of each latch mechanism. Preferably the camshafts for pivoting the two sets of latch members are driven by a single drive connected, via a transmission, to both camshafts.

In an embodiment of a storage device according to the invention, the latch members, the rotary camshaft are held in a latch support structure, which latch members, rotary camshaft and support structure together form a latch mechanism. The latch mechanism, preferably the support structure of the latch mechanism, is preferably provided with coupling means, e.g. a hook or opening, for lifting the latch mechanism using a crane. This facilitates moving the latch mechanism, in and out off place, for example for installing the latch mechanism on the finger of a tubular storage device and for removing the latch unit for maintenance.

The invention furthermore provides a retrofit unit, comprising the above mentioned latch mechanism, for mounting on an existing tubulars storage device to create a tubulars storage device according to the invention.

The invention furthermore provides an oil and gas industry drilling structure, e.g. a drilling derrick, comprising a tubulars storage device according to the invention. It will be appreciated that the drilling structure can be a land based structure (e.g. a transportable land based structure), an offshore structure (e.g. a platform), or a drilling vessel mounted structure.

DETAILED DESCRIPTION OF PREFERRED EMBODIMENTS

Figure 1:
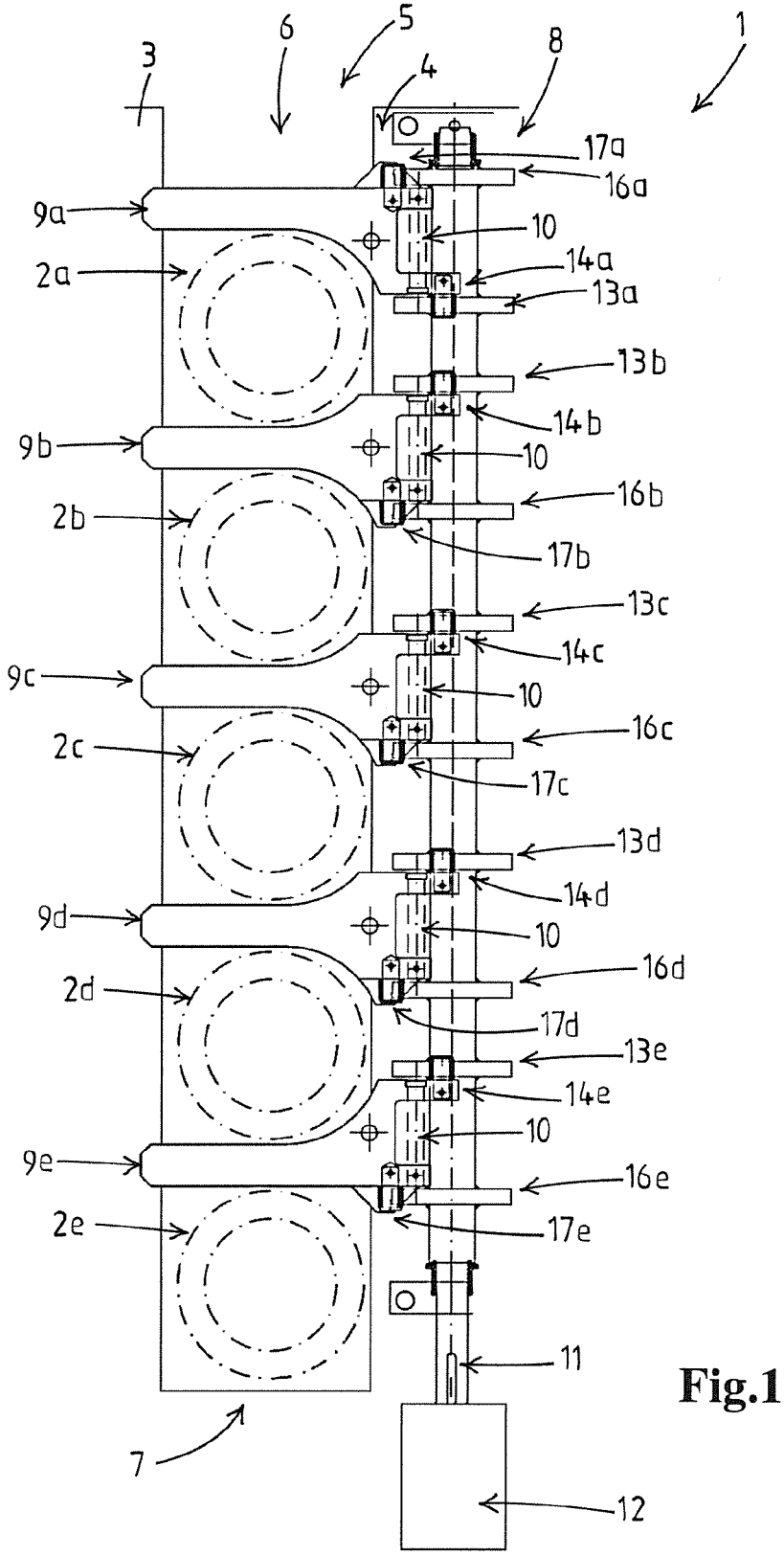
FIG. 1 shows a top view of an example of a tubulars storage device according to the invention having latch members in a closed position.
Figure 2:
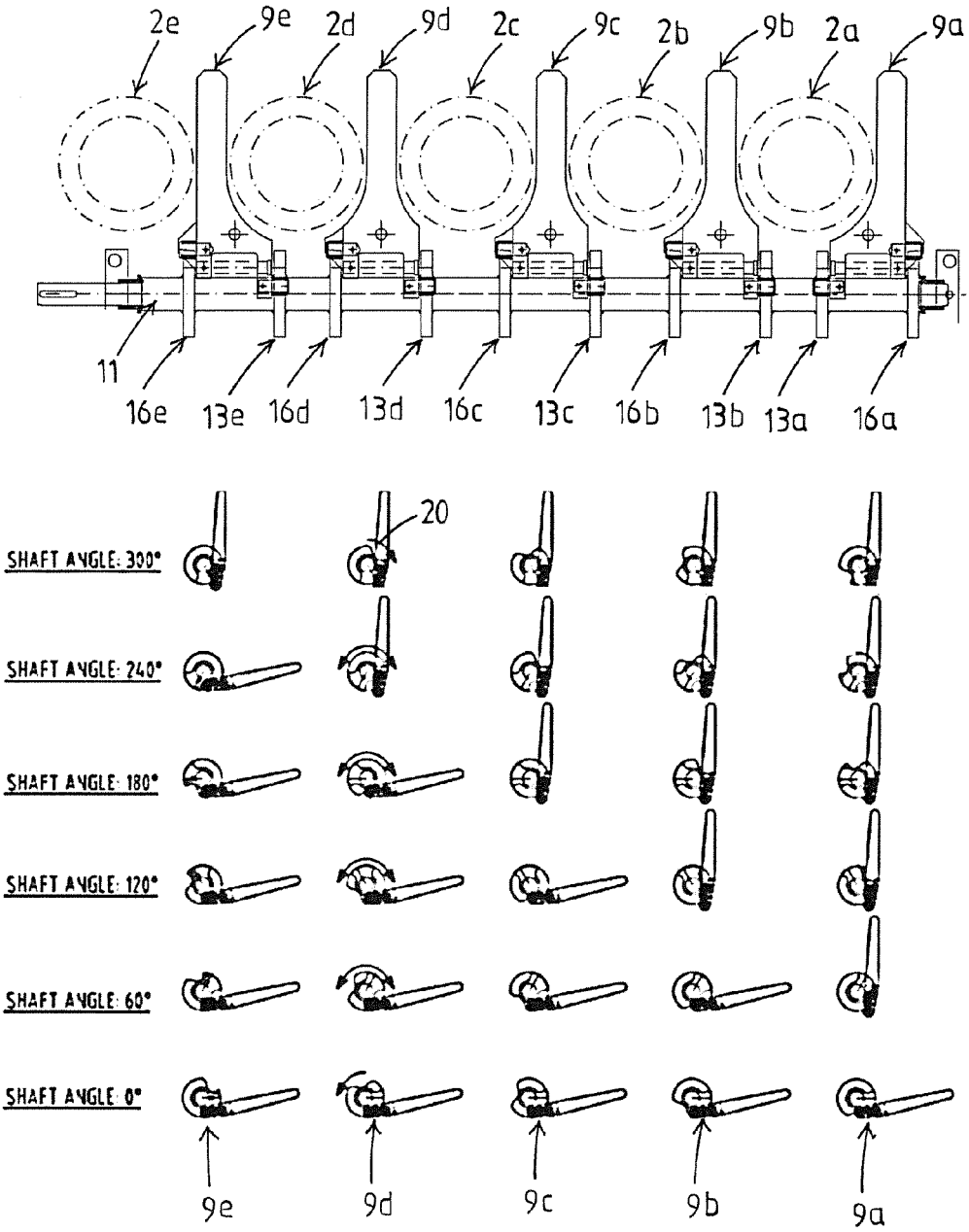
FIG. 2 shows in a top view a latch mechanism of the tubular storage device of FIG. 1, and a side view of the positions of the latch members of the tubular storage device at different positions of the camshaft.
Figure 3:
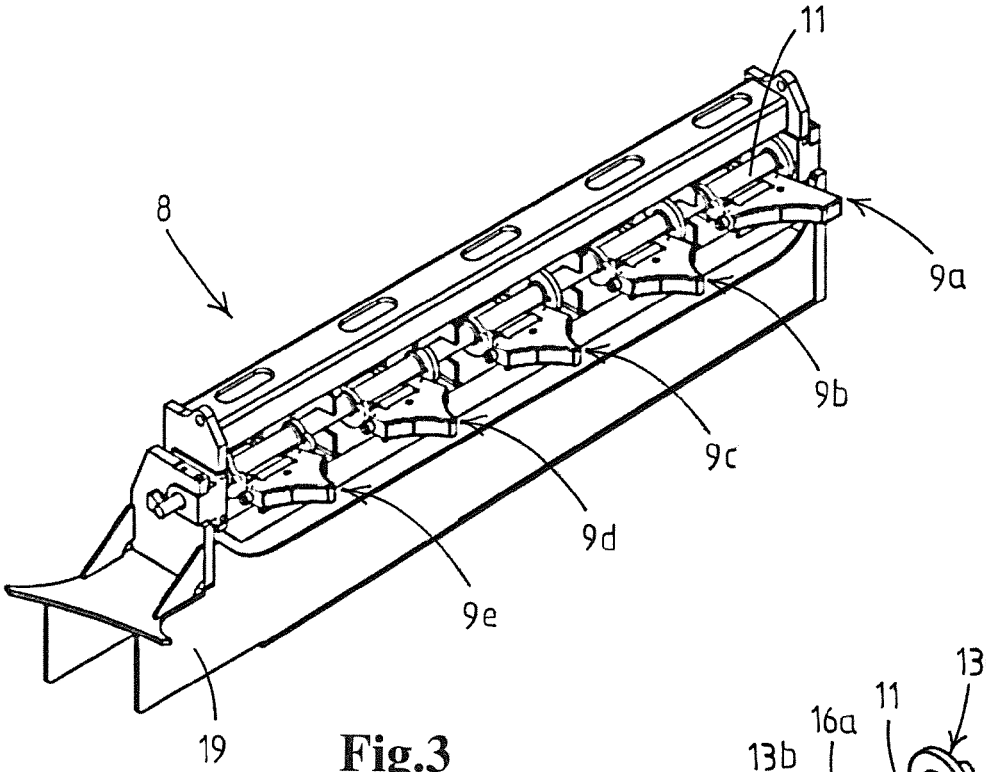
FIG. 3 shows a perspective view of part of a tubular storage device similar to the tubulars storage device of FIG. 1.
Figure 4:
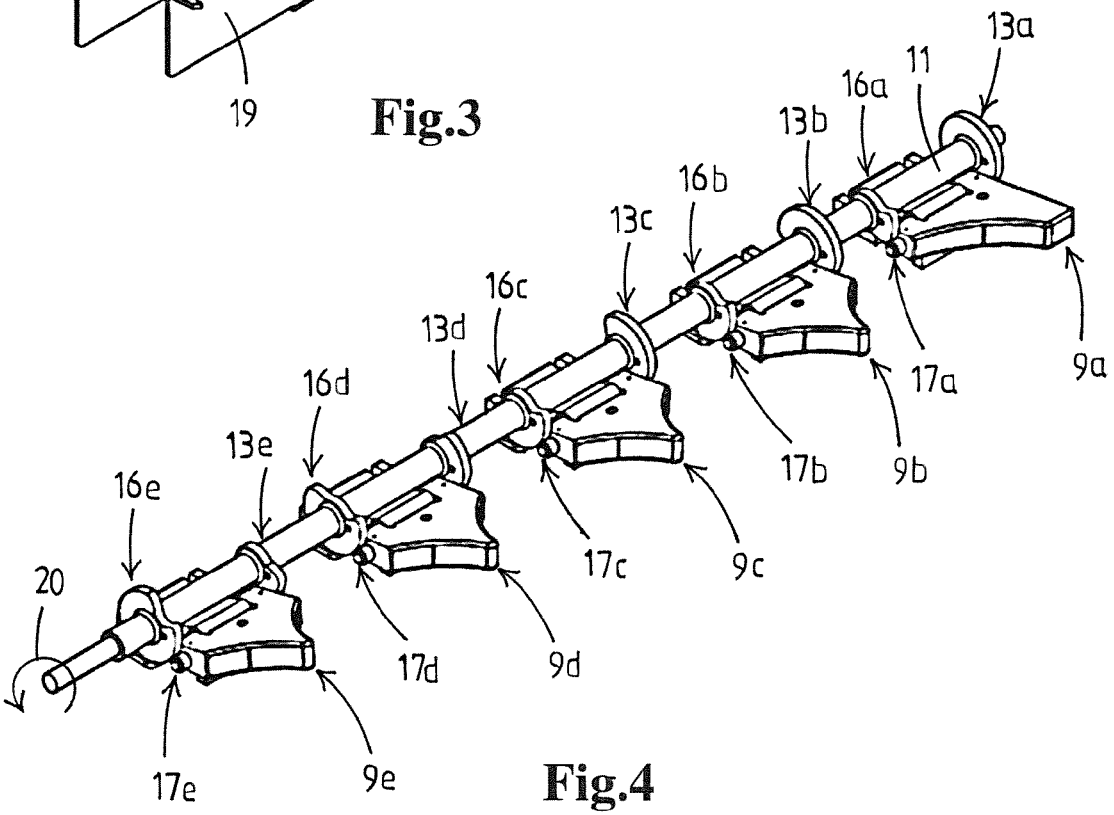
FIG. 4 shows a perspective view of the camshaft and the latch members of the part of the tubular storage device shown in FIG. 3.
Figure 5:
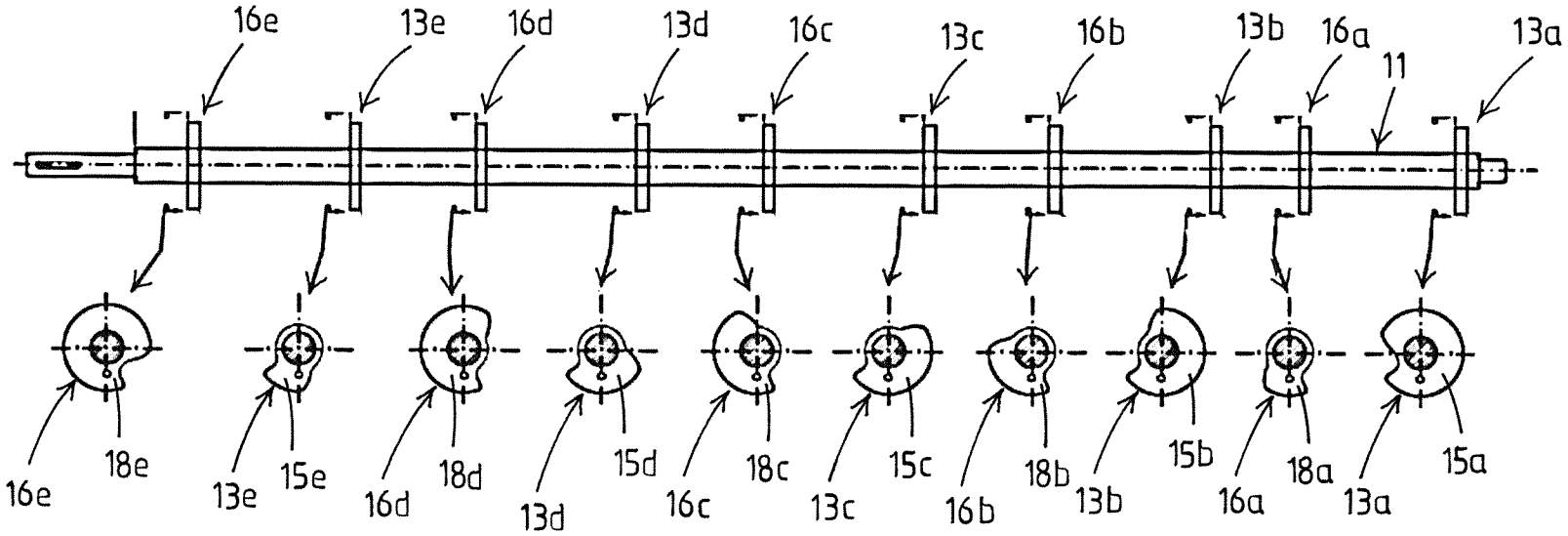
FIG. 5 shows a side view of the camshaft of FIG. 4 with its opening cams and closing cams, which cams are each also shown in a frontal view.

Referring to FIGS. 1-5 a preferred embodiment of a tubulars storage device 1 according to the invention for storing a plurality of tubulars 2*a-e* will be explained in detail. FIGS. 1 and 2 show a first embodiment according to the invention and FIGS. 3-5 show a second embodiment according to the invention that only in detail differs from the first one. More in particular, the tubulars storage device shown in FIGS. 3-5 differs form the one shown in FIGS. 1 and 2 in that the latches have a slightly different shape and in that all the latches are mounted in the same position. In the first embodiment, one of the latches has been mounted in a mirrored position. These differences are not relevant for the functioning of the device. Therefore, similar parts have been provided with the same reference signs.

As mentioned above the term "tubulars" is a known term in the oil and gas industry and is intended to cover all tubular products used for well drilling and other well related activities. In the examples shown herein it is assumed that the tubulars 2*a-e* are stored in vertical position, but the storage device according to the invention is also suited for other orientation of the tubulars, e.g. horizontal storage.

The tubulars 2*a-e* may be suspended in vertical position from the storage device, e.g. by each tubular having a larger diameter head (e.g. a connector head) which engages on the storage device, e.g. on suspension members mounted at a higher level than the finger members.

In the embodiments shown, it is assumed that the lower ends of the vertically arranged tubulars are resting on a support surface (not shown) of the tubulars storage device, e.g. having a position member engaging the lower end of each tubular to hold it in position.

In general the storage device 1 includes a pair of spaced apart finger members 3,4 (e.g. plate members) forming therebetween a slot 5, the slot has an opening 6 at its front end and has a closed end 7 at its rear end. It is noted that in an alternative embodiment of the storage device (not shown) the slot is also open at the rear of the slot. This could e.g be used to empty the storage device at one end of the slot and filling the storage device from the other end of the slot or to combine multiple storage devices, as will be explained further on.

The slot 5 forms a path of displacement for tubulars 2*a-e* allowing to place tubulars at respective storage positions distributed along the slot 5 as well as removal of said tubulars from the slot 5. The tubulars 2*a*-2*e* are in FIG. 1 shown in cross section. In the example shown, the slot 5 is configured to receive five tubulars 2*a-e*. For example the tubulars are pre-assembled multiple pipe joints (e.g. triples or quads) as often found in the oil and gas drilling industry.

In this example a latch mechanism 8 is shown for the group of five tubulars. The latch mechanism 8 is mounted on a finger member 4, and comprises a plurality of latch members 9*a-e*, a camshaft 11 and a latch support structure 19. The latch members 9*a-e* are arranged at spaced apart locations along the slot 5, and are effective between the storage positions of the tubulars 2*a-e*.

Figure 9:
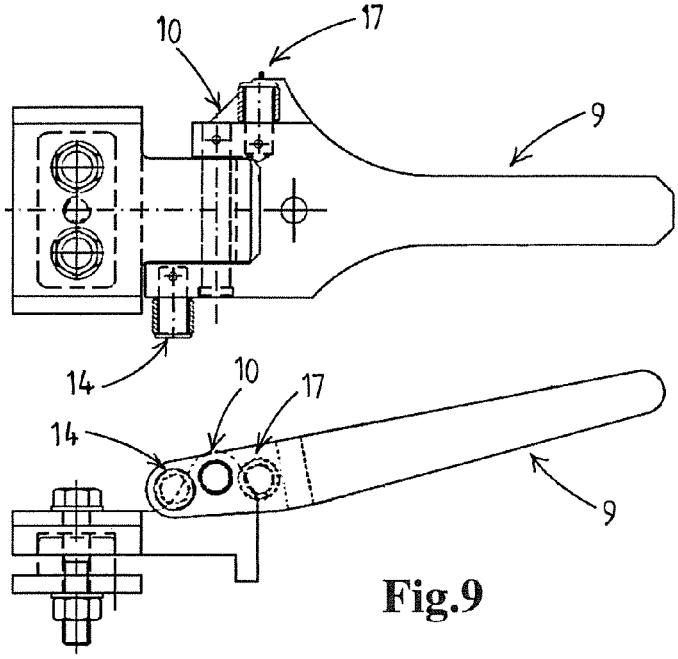
FIG. 9 shows top view and a side view of a latch and mounting bracket of the tubulars storage device of FIG. 1.

The latch members 2*a-e* are each pivotably supported by a pivot axis 10 mounted substantially parallel to the slot 5, such that they can each be pivoted between a closed position, shown in FIG. 1, and an opened position. FIG. 9 shows a latch in more detail.

In their closed position the latch members 9*a-e* each extend in the path of displacement of tubulars 2*a-e*, i.e. along the slot 5, thereby prohibiting displacement of the tubulars along the slot 5. In their opened position, the latch members 9*a-e* are each pivoted out off the path of displacement of tubulars 2*a-e*, and preferably extend substantially parallel to a longitudinal axis of a tubular in a storage position.

The latch members 9*a-e* are each provided with a first cam follower 14*a-e*, for interacting with opening cams 13*a-e* mounted on a rotary camshaft 11 for actuation of pivoting motion of the latch members 9*a-e*.

The rotary camshaft 11 is mounted substantially parallel to the slot 5. The rotary camshaft 11 is provided with a drive 12, here a suitable electric drive, connected to one end thereof. The drive 12 is adapted to effect controlled angular rotation of the camshaft 11. The drive 12 is adapted to selectively bring the camshaft 11 in one of a number of distinct angular positions, in the particular embodiment shown six, said number corresponding to the number of opening cams on the latch member shaft plus one. Of course the drive 12 could be configured to provide further distinct angular positions of the shaft 11 for other purposes when desired. The drive can be placed in a protective housing or behind a protective shield, preferably further rearward than the rear of the slot 5. The drive 12 could be of any suitable design, e.g. including a hydraulic actuator.

FIG. 3 shows a perspective view of part of a tubulars storage device similar to the tubular storage device 1 of FIG. 1, more in particular of the latch mechanism 8 of the tubular storage device 1. FIG. 4 shows a perspective view of the camshaft 11, with opening cams 13*a-e*, and the latch members 9*a-e* of the part of the tubular storage device shown in FIG. 3.

The opening cams 13*a-e* are mounted on the camshaft 11 so as to rotate with the camshaft. The opening cams 13*a-e* are arranged at spaced apart locations along the camshaft 11 so as to each interact with the first cam follower 14*a-e* of an associated latch member 9*a-e*. Thus, by rotating the rotary camshaft 11, opening cams 13*a-e* engage first cam followers 14*a-e* to pivot the latches 9*a-e*.

The opening cams 13*a-e* are shaped such that when the rotary camshaft 11 is driven in a main direction, indicated with arrow 20 in FIG. 4, the latches 9*a-e* are, one after the other, moved from their closed position into their opened position. To enable this, each opening cam 13*a-e* has an angular opening extension 15*a-e* that, when the drive 11 drives the camshaft 11 in the main direction 20, engages the associated cam follower 14*a-e* of respective latches 9*a-e*. The drive thus enables the latch members to be pivoted from their closed position into their opened position.

FIG. 5 shows a side view of the camshaft 11 of FIG. 4 with its opening cams 13*a-e*. The cams of the rotary camshaft are each also depicted in a frontal view in the lower half of the figure. The opening cams 13*a-e* include a front opening cam 13*a*, having a largest angular opening extension 15*a*, and a rear opening cam 13*e*, having a smallest angular opening extension 15*e*, as well as one or more intermediate opening cams 13*b-d* between the front opening cam 13*a* and the rear opening cam 13*e*. Each of the intermediate opening cams 13*b-d* has a smaller angular opening extension 15*b-e* than the preceding opening cam on the camshaft. Thus, the angular extension of the opening cams 13*a-e* becomes smaller, more in particular the angle over which the angular extensions extend becomes smaller, as one goes further to the rear of the group of opening cams on the shaft 11.

FIG. 2 shows a top view of the latch mechanism 8 of the tubular storage device of FIG. 1. In addition, in its lower part FIG. 2 shows a side view of the positions of the latch members 2*a-e* of the tubular storage device 1 at different shaft angles, i.e. different angular positions of the camshaft 11. The first, bottom, row depicts the position of the latches at a shaft angle of 0 degrees, the second row depicts the position of the latches at a shaft angle of 60 degrees, the third row depicts the position of the latches at a shaft angle of 120 degrees, the fourth row depicts the position of the latches at a shaft angle of 180 degrees, the fifth row depicts the position of the latches at a shaft angle of 240 degrees, and the sixth, top, row depicts the position of the latches at a shaft angle of 300 degrees.

In their closed position, the latches 2*a-e* of the embodiment shown extend in a substantially horizontal direction. In their opened position, the latches 2*a-e* of the embodiment shown extend in a substantially vertical direction.

In the embodiment shown, the latches 2*a-e* are pivoted in an upward direction when moved form their closed position to their opened position. Thus the pull of gravity can be used for moving the latches towards their closed position. Preferably, the pull of gravity is used for pushing the cam first followers of the latches against the cams surfaces of the associated opening cams, thus contributing to a continue contact between cams and cam followers and thus to a controlled movement of the cams.

In an alternative embodiment, the latches and cam shaft are configured such that the latches are pivoted in a downward direction from a horizontal closed position towards a vertical opened position and visa versa. Thus the pull of gravity can be used for moving the latches towards their opened position.

The angular opening extension 15*a-e* of each of the opening cams 13*a-e* on the camshaft 11 is chosen such that in a first angular position of the camshaft, in the particular embodiment shown at 0 degrees, all latch members 9*a-e* are in their closed position. In this first angular position of the rotary camshaft all latch members extend in the path of displacement of tubulars, thereby prohibiting displacement of the tubulars along the slot, which is shown in FIGS. 1-4.

When the camshaft 11 is driven in the main direction 20 from the first angular position into a second angular position, in the particular embodiment shown over an angle of 60 degrees, only the front latch member 9*a* is moved by the front opening cam into its opened position. In this second angular position only the front latch member 9*a* is located out of the path of displacement thereby allowing the passage of a tubular form a first storage position in the storage slot. The tubular 2*a*, shown in FIG. 1, can then be removed from the tubulars storage device, whereas all other tubulars 2*b-e* are retained.

When the camshaft is subsequently driven in the main direction into each subsequent angular position, in the particular embodiment shown over angles of 60 degrees each, a successive latch member is pivoted into its opened position with each subsequent angular position by a successive opening cam. Furthermore, the latches already moved into their opened position are retained in that position, in the embodiment shown by their associated opening cam.

In the third angular position of the camshaft 11, at an angle of 120 degrees, the front latch member 9*a* remains located out of said path of displacement of the tubulars, and the successive latch member (here member 9*b*) is also located out of said path of displacement, thus allowing the removal of tubular 2*b*. In the further subsequent angular positions the latch members 9*a*, 9*b* remain out of said path of displacement and now also the latch member 9*c* is moved out of said path, thus unlocking the tubular 2*c*.

Figure 6:
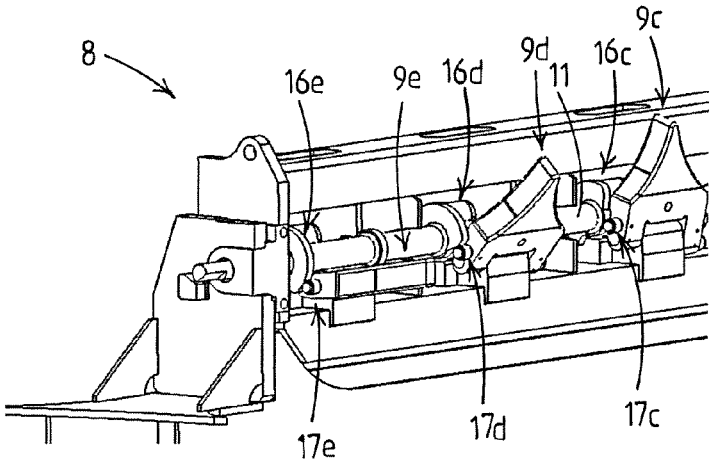
FIGS. 6-8 show a perspective view of part of the tubular storage device of FIG. 3 in subsequent working positions.
Figure 7:
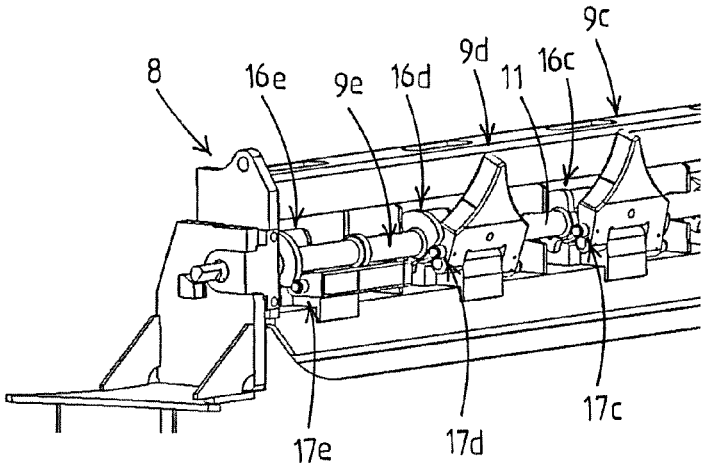
Figure 8:
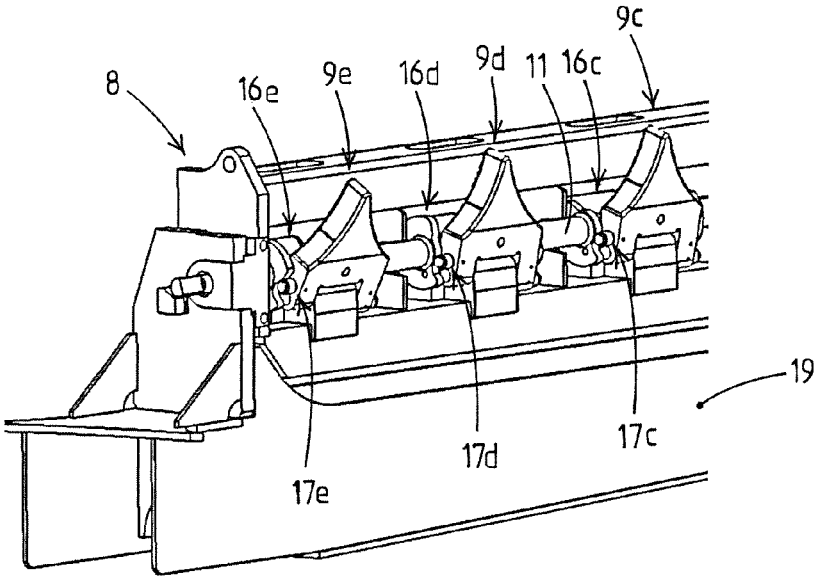

When the rotary camshaft 11 is thus rotated into its final angular position, in the embodiment shown over a total angle of 300 degrees and in its sixth angular position, all the latches 9*a-e* are moved into their opened position and are retained in that position. The latch members are thus all effectively locked in their opened position, located out of the path of displacement of tubulars 2*a-e*, thereby allowing displacement of the tubulars along the slot. FIGS. 6-8 depict in a perspective view the last but one and the last latch being pivoted into their opened position.

Thus, by simple step-by-step rotation of the shaft 11 in the main direction, the latches 9*a-e* are successively pivoted into their opened position, allowing further tubulars to be removed from the storage device. Thus, the latches are opened in sequential order.

It will be appreciated that the drive can be driven in the counter direction, i.e. in a direction opposite to the main direction, to sequentially move the latches from the opened position into the closed position.

It will be appreciated that further rotation of the shaft 11 from the "final angular position" allows to bring the shaft in its first position again so that all latch members 9*a-e* are locked again. In this embodiment, all latch members are thus simultaneously moved into their closed position.

In a further embodiment of a storage device according to the invention, the cams are shaped such that, when the camshaft is driven in the counter direction from the first angular position into the final angular position, all latch member are simultaneously moved by the opening cams into their opened position. Thus, the tubular storage device is provided with the ability to quickly move all latches from their closed position into their opened position.

In the particular embodiment shown the angular opening extension 15*a-e*, see FIG. 5, of the opening cams 13*a-e*, associated with the first cam follower 14*a-e* of a latch 9*a-e*, have a constant radius flank, i.e. a flank extending at a substantial constant radius with respect to the axis of rotation of the camshaft 11. A constant radius flank allows for positioning a cam follower rather than moving the cam follower and thus allows for retaining an opened latch in the opened position while the camshaft rotates in the main direction to open the subsequent latches. Thus, the latch members are retained in their opened position by the opening cams. More in particular, the angular extensions 15*a-e* are thus shaped such that they not only move the cam follower of a corresponding latch, but also prevent the cam follower from moving back to its initial position while the cam followers of the subsequent latches are moved to pivot the subsequent latches into their opened position. The opening cams of the embodiment shown thus retain the latch members in their opened position, which latches are therefore effectively locked in their opened position by the opening cam.

In the particular embodiment shown, the camshaft 11 is not only provided with opening cams 13*a-e*, but with closing cams 16*a-e* also. Furthermore, the latch members 9*a-e* are each provided with a second cam follower 17*a-e* for interacting with the closing cams 16*a-e*. The closing cams 16*a-e* are mounted on the camshaft 11 so as to rotate with the camshaft, and are arranged at spaced apart locations along the camshaft 11 so as to each interact with the second cam follower 17*a-e* of an associated latch members 9*a-e*.

The closing cams 16*a-e* are shaped such that when the rotary camshaft 11 is driven from its final position in a counter direction, opposite to the main direction indicated with arrow 14 in FIG. 4, the latches 9*a-e* are, one after the other, moved from their opened position into their closed position. To enable this, each closing cam 16*a-e* has an angular closing extension 18*a-e* that, when the drive 11 drives the camshaft 11 in the main direction 20, engages the second cam follower 17*a-e* of respective latches 9*a-e* and push the latches towards their closed position. The drive thus causes the latch members to pivot from their opened position into their closed position.

FIG. 5 shows a side view of the camshaft 11 of FIG. 4 with its closing cams 16*a-e*. The cams of the rotary camshaft are each also depicted in a frontal view. The closing cams 16*a-e* include a front closing cam 16*a*, having a smallest angular closing extension 18*a*, and a rear closing cam 16*e*, having a largest angular closing extension 18*e*, as well as one or more intermediate closing cams 16*b-d* between the front closing cam 16*a* and the rear closing cam 16*e*. Each of the intermediate closing cams 16*b-d* has a larger angular closing extension 18*b-e* than the preceding closing cam on the camshaft. Thus, the angular extension of the closing cams becomes larger, more in particular the angle over which the angular extensions extend becomes larger, as one goes further to the rear of the group of closing cams on the shaft 11.

The angular closing extension 18*a-e* of the closing cams 16*a-e* on the camshaft 11 is chosen such that when the camshaft is driven, in the counter direction, from the final angular position into the preceding angular position, only the back closing cam 16*e* is moved into its closed position. The back latch member 9*e* is released by the back opening cam 13*e* and is pushed by the back closing cam 16*e* into the path of displacement of the tubulars and into its closed position. In this example the tubular 2*e* is then locked in its storage position in the storage device 1.

When the cam 11 is subsequently driven, in the counter direction, into each preceding angular position, a preceding latch member is released by a preceding opening cam and is pivoted into its closed position with each subsequent angular position by a preceding closing cam. Furthermore, the latches already moved into their closed position are retained in that position by their associated closing cam.

When the camshaft is thus pivoted into the first position, all latch members are retained, in the embodiment shown by their closing cams, in their closed position, and are thus all effectively locked in this position, extending in the path of displacement of tubulars, thereby prohibiting displacement of the tubulars along the slot.

Thus, by simple step-by-step rotation of the shaft 11 in the counter direction, the latches 9*a-e* are successively pivoted into their closed position, locking a further tubular into a storage position of the storage device. The latches are thus closed in sequential order.

Furthermore, in the embodiment shown, by driving the drive in the counter direction the latches are each released by an opening cam, pivoted by a closing cam into its closed position, and locked by the closing cam in the closed position.

How the opening cams retain a latch in the opened position has been explained above already. The closing cams block the latches in their closed position in a similar fashion. In the embodiment shown, the closing cams 16*a-e* are each provided with an angular closing extension 18*a-e*, associated with the second cam follower 17*a-e* of latch members 9*a-e*. The angular closing extension 18*a-e* has a constant radius flank for retaining a closed latch in its closed position, for example while the camshaft rotates in the counter direction to close preceding latches.

Thus, the angular extensions 18*a-e* are shaped such that they not only move the cam follower of a corresponding latch, but also prevent the cam follower from moving back to its initial position. The closing cams thus retain the latch members in their closed position, which latches are thus effectively locked in their closed position by the closing cam. It is noted that in the preferred embodiment shown, the opening cams are designed for preventing the latch members from pivoting beyond their closed position. Thus, when in their closed position, a latch member is with its cam followers locked inbetween the opening cam and the closing cam such that it can not pivot towards its opened position or beyond its closed position.

Furthermore, in the embodiment shown, the closing cam and the opening cam, each have guide flanks. These flanks are the surfaces facing outward, in radial direction, for guiding the cam followers. The flanks are formed such that each latch is with its cam followers enclosed between the flank of the opening cam and the flank of the closing cam, even when not in its closed or opened position.

Thus, when a latch is pivoted from its closed position towards its opened position, the opening cam, more in particular angular extension of the opening cam, engages the first cam follower to pivot the latch. Simultaneously, the closing cam, more in particular the flank of the closing extension of the closing cam, releases the second cam follower, i.e. moves away to allow movement of the cam and thus the latch member towards its opened position. During the movement of the latch towards the opened position, the flank of the closing cam remains in close approximation of the second cam follower.

Thus, no, or only limited, free movement of the latch is possible at any given position of the camshaft. The latch member is effectively locked inbetween the opening cam and the closing cam at each position of the camshaft.

It will be appreciated that in the embodiment shown, the closing cams are shaped such that by rotation of the shaft 11 in the counter direction from the first angular position to the final angular position all latch members essentially simultaneously released by the opening cams and are essentially simultaneously pivoted by the closing cams into their opened position. Furthermore, when the camshaft is driven in the main direction from the final angular position into the first angular position, all latch member are essentially simultaneously released by the opening cams and are essentially simultaneously moved by the closing cams into their closed position.

In an alternative embodiment, the cams are shaped such that when the camshaft is driven in the main direction from the final position into the first position, the latches are closed in a sequential order, starting with the latch at the back of the slot and ending with the latch at the opening of the slot. Thus the latches are opened and closed in a sequential order by driving the camshaft in the main direction.

It will be appreciated that with respect to the opening and closing cams the angular extension is considered to be the extension of the cam for engaging a cam follower of a latch member an pushing the cam follower such that the latch member is pivoted about its pivot axis.

In the embodiment shown, the angular extension of the opening cams extends such that it also engages the associated cam follower after the latch member is pivoted into its opened position to maintain the latch member in its opened position.

Furthermore, in the embodiment shown, the angular extension of the closing cams extends such that it also engages, or is in close approximation with, the associated cam follower after the latch member is pivoted into its closed position to retain the latch member in its opened position.

In the embodiment shown, the first cam follower and the second cam follower, associated with an opening cam and a closing cam respectively, of each latch member are located on opposite lateral sides of the respective latch member. Thus, each latch member is located inbetween an opening cam and an closing cam.

In the embodiment shown, the first cam follower and the second cam follower, associated with an opening cam and a closing cam respectively, of each latch member are located on opposite sides of the pivot axis supporting the respective latch member. Thus, both the closing cams and the opening cams can push their associated cam follower away from the camshaft for pivoting the latch member. This allows for a simple and robust design of the latch mechanism.

In the embodiment shown, the latches, when in their locking position, extend fully across the fingerboard slot. Thus, in their closed position, the latches block the entire slot. In an alternative embodiment, the latches extend only over part of the slot, for example over half the slot. In a further embodiment, on the opposite side of the slot, latch receiving members are provided for receiving a distal end of the latch. The latch receiving member can for example be a U-shaped recess for receiving the end section latch member therein, or be a pin that engages a hole in the end section of the latch member. Thus, the latch, when in its closed position, is supported on both sides of the slot when in its closed position, and may support larger loads. Furthermore, when engaged by a latch receiving member, for example a U-shaped recess, the latch is provided with a support to further secure the latch against movement in the horizontal plane, in particular along the slot.

In an embodiment of a storage device according to the invention, the latches, when in their opened position, extend in a direction parallel to a longitudinal axis of a tubular in a storage position, and latch receiving members are provided for receiving a distal end of the latch when in its opened position. Thus, the latch, when in its opened position, is supported on both ends.

A latch member of a storage device according to the invention, or at least the portion thereof which effectively extends into the path of the tubulars, is preferably embodied as a solid metal body, e.g. shaped as an arm or rod. In an embodiment, the base of the arm or rod, located near the pivot axis, is curved for receiving the contour of a tubular element, and for providing a solid connection between the arm and the part of the latch member engaging the pivot axis.

In the embodiment shown, the cam followers are cylindrical shaped, preferably pivotably mounted, extensions. In an alternative embodiment, the latch member is provided with a contact surface, integral with the latch member, that functions as a cam follower. Thus, the associated cam engages a surface of the latch when pivoting the latch member.

In the embodiment shown, the cams retain the latches in their closed and opened position, more in particular, the opening cams retain the latches in their opened position and the closing cams retain the latches when in their closed position. The cams release the latches for opening or closing the latches, i.e. an opening cam pivoting a latch into its opened position and a closing cam pivoting a latch into its closed position. Thus the cams shown not only move the latches between their closed and opened position, but also lock the latches in their closed and opened position.

Figure 11:
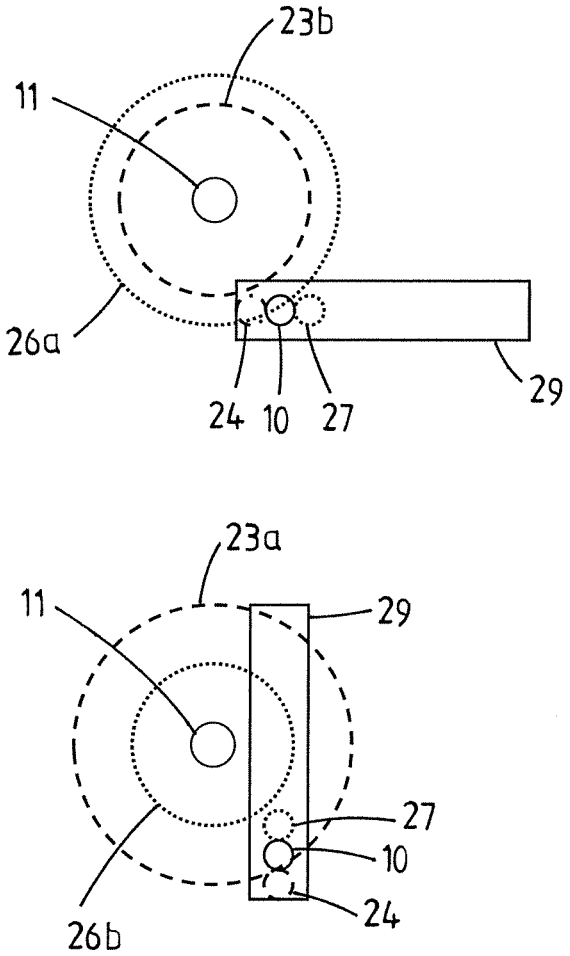
FIG. 11 shows a schematic lay out of an inner diameter and outer diameter of an opening cam and a closing cam according to the invention.

For explanatory purposes, FIG. 11 depicts a view parallel to a longitudinal axis of a camshaft. FIG. 11 provides a schematic lay out of an inner diameter of a guide flank and an outer diameter a guide flank of both an opening cam 23 and a closing cam 26 with respect to the respective first cam follower 24 and the second cam follower 27 on the latch member 29, of an embodiment according to the invention. The latch member is depicted in an closed position in the upper half of the figure and in an opened position in the bottom half of the picture. The outer diameter 23*a* and the inner diameter 23*b* of the guide flank of an opening cam is depicted in dashed lines. The first cam follower 24, which interacts with the opening cam, is depicted in dashed lines as well.

The outer diameter 26*a* and the inner diameter 26*b* of the guide flank of a closing cam is depicted in dotted lines. The second cam follower 27, which interacts with the closing cam, is also depicted in dotted lines.

In FIG. 11 only the inner and outer diameter of the guide flanks of a cam are shown, the guide flanks themselves are not depicted. In practice, a section of a guide flank of a cam has an outer diameter, and a section of the guide flank of a cam has an inner diameter. The guide flank is furthermore provided with an intermediate section in which the radius of the guide flank progresses from the inner to the outer diameter and an intermediate section in which the radius of the guide flank reduces from the outer diameter to the inner diameter. These intermediate sections (not shown in FIG. 11) allow for movement of the latch between the opened and closed position.

In the embodiment shown in FIG. 11, the outer diameter 26*a* of the closing cam is dimensioned such that when the latch 29 is in its closed position, depicted in the upper half of FIG. 11, the guide surface of the closing cam (not depicted) prevents the second cam follower 27 from moving in an essentially upward direction, and thus prevents the latch 29 from pivoting about its pivot axis 10 into its opened position.

In the embodiment shown, the inner diameter 23*b* of the opening cam is dimensioned such that when the latch is in its closed position, the guide flank of the opening cam (not shown) prevents the first cam follower 24 from moving in an essentially upward direction, and thus prevents the latch 29 from pivoting about its pivot axis 10 beyond its closed position.

Thus, in the embodiment shown, the latch member, when in its closed position, is with its cam followers locked inbetween the opening cam and the closing cam such that it can not pivot towards its opened position or beyond its opened position.

In the embodiment shown in FIG. 11, the outer diameter 23*a* of the opening cam is dimensioned such that when the latch 29 is in its opened position, depicted in the lower half of FIG. 11, the guide surface of the opening cam (not shown) prevents the first cam follower 24 from moving in an essentially upward direction, and thus prevents the latch 29 from pivoting about its pivot axis 10 into its closed position.

In the embodiment shown, the inner diameter 26*b* of the closing cam is dimensioned such that when the latch is in its opened position, the guide flank of the closing cam (not shown)_prevents the second cam follower 27 from moving in an essentially upward direction, and thus prevents the latch 29 from pivoting about its pivot axis 10 beyond its opened position.

Thus, in the embodiment shown, the latch member, when in its opened position, is with its cam followers locked inbetween the opening cam and the closing cam such that it can not pivot towards its closed position or beyond its opened position.

An angular extension of a cam comprises a section of the guide flank having an outer diameter as well as an intermediate section of the guide flank having a radius that increases from the inner to the outer diameter. The effective angular extension, being a closing extension or an opening extension, of a cam can easily be configured by the skilled person, based on the information provided above and depending on the number of latch members on the shaft. A practical number of latch members on a shaft is four or five, but other numbers are also possible.

Figure 10:
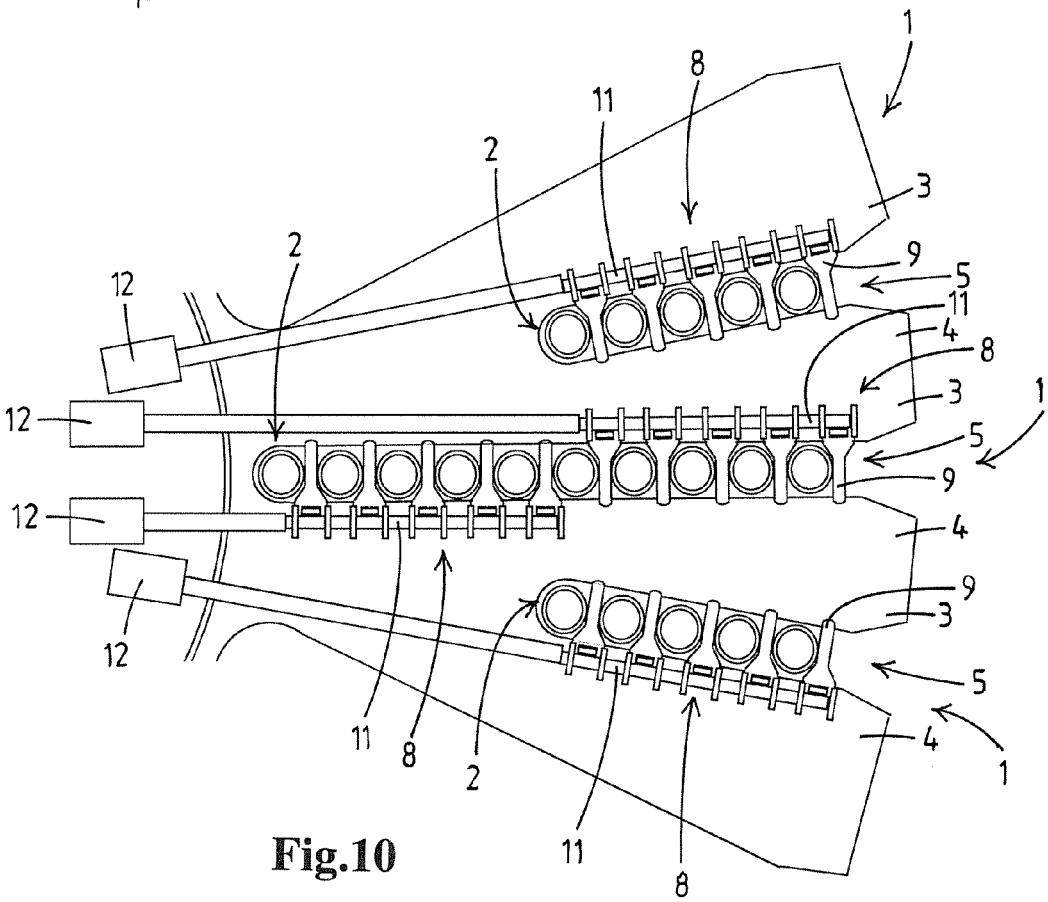
FIG. 10 shows a combination of multiple tubulars storage device according to the invention.

FIG. 10 shows an embodiment comprising multiple tubulars storage devices according to the invention, i.e. multiple slots for storing a plurality of tubulars, each slot provided with at least one latch mechanism. In the particular embodiment shown, each latch mechanism comprises latch members with an associated camshaft and a latch support structure. The central slot is provided with two of those latch mechanisms, mounted at opposite sides of the storage slot. The two latch mechanism each define a number of storage positions.

Thus, the central slot is provided with ten storage positions. It is noted that in an alternative embodiment, multiple latch mechanisms can be mounted side by side along a storage slot. In the particular embodiment shown, the drives for rotating the respective camshafts are located in an area separated from the tubular storage area. The drives are connected to the camshafts via an intermediate shaft which is guided, via openings, through a wall separating both areas. Thus, the drives can for example be located in a protected area, for example in a room with a controlled temperature and or humidity, while the storage slots are located in the outside and are subjected to the elements.

In a further embodiment of a storage device according to the invention, a central storage slot is provided with two latch mechanisms on opposite sides thereof and the two latch mechanisms are arranged to be active for the same tubular storage positions, i.e. the latch mechanisms are mounted opposite each other. The latches of each set extend preferably over about half the slot for together locking a tubular in a storage position. In a further embodiment, the latches have distal ends shaped for engaging an associated latch of the set on the opposite side of the slot. Thus, a tubular, when locked in a storage position, is blocked by a latch of each latch mechanism. Preferably the camshafts for pivoting the two sets of latch members are driven by a single drive connected, via a transmission, to both camshafts.

In the embodiment of a storage device according to the invention, the latch members, the rotary camshaft are held in a latch support structure, which latch members, rotary camshaft and support structure together form a latch mechanism. The latch mechanism, preferably the support structure of the latch mechanism, is preferably provided with coupling means, e.g. a hook or opening, for lifting the latch mechanism using a crane. This facilitates moving the latch mechanism, in and out off place, for example for installing the latch mechanism on the finger of a tubular storage device and for removing the latch unit for maintenance.

It is noted here that the slot 5 can be formed by a finger member delimiting one side of the slot, the opposite side of the slot being formed by the latch mechanism 8 so without a finger member at said side of the slot. Also a slot 5 could be delimited by two spaced apart shafts latch mechanisms in the absence of finger members or the like.

In a further embodiment, the latch mechanism and/or the finger member defining the slot are mounted for movement in a direction perpendicular to the longitudinal direction of the slot. Thus, the width of the slot can be adapted to the width of the tubulars to be stored. For example a four bar mechanism can be used to move and guide the latch mechanism and/or the finger mechanism in a direction perpendicular to the longitudinal direction of the slot, while remaining parallel thereto.

In an alternative embodiment, the storage slot is defined by the latch mechanism on one side thereof and a finger on the other end thereof, and the finger is configured as a rotatable cam, extending along the slot and having a progressive diameter. The cross section of the finger may thus be shaped like a comma, therefore, by rotating the finger the width of the storage slot is adjusted.

The invention claimed is:

1. A tubulars storage device for storing a plurality of tubulars, said tubulars storage device comprising:

spaced apart finger members forming therebetween a slot having an opening at a front end thereof, said slot forming a path of displacement for tubulars allowing placement of tubulars at respective storage positions distributed along the slot and removal of said tubulars from the slot;

a plurality of latch members arranged at spaced apart locations along the slot between said storage positions of the tubulars, said latch members each being mounted pivotably on a pivot axis mounted substantially parallel to the slot, such that said latch members can each be pivoted between a closed position and an opened position between said storage positions of the tubulars, wherein the latch members in the closed position each extend in the path of displacement of tubulars along the slot, thereby prohibiting displacement of the tubulars along the slot, and wherein the latch members are each provided with a first cam follower;

a rotary camshaft for actuation of pivoting motion of the latch members, the rotary camshaft being mounted substantially parallel to the slot;

a drive connected to the rotary camshaft, said drive being adapted to effect controlled angular rotation of the camshaft; and a plurality of opening cams mounted on the camshaft so as to rotate with the camshaft, the plurality of opening cams being arranged at spaced apart locations along the camshaft so as to each interact with the first cam follower of an associated latch member, wherein each opening cam has an angular opening extension that, when the drive drives the camshaft in a main direction, causes the associated latch member to move to the opened position, wherein said plurality of opening cams includes a front opening cam having a largest angular opening extension and a rear opening cam having a smallest angular opening extension and one or more intermediate opening cams between said front and rear opening cam, each of said intermediate opening cams having a smaller angular opening extension than a preceding opening cam on the camshaft, wherein the drive is adapted to selectively bring the camshaft in one of a number of distinct angular positions, said number corresponding to the number of opening cams on the latch member shaft plus one, and wherein the angular opening extension of each of the opening cams on the camshaft is configured such that:

in a first angular position of the camshaft, all latch members are in the closed position, extending in the path of displacement of tubulars, thereby prohibiting displacement of the tubulars along the slot, when the camshaft is driven in the main direction from the first angular position into a second angular position only a front latch member is moved by the front opening cam out of said path of displacement of the tubulars and into the opened position, thereby allowing the passage of a tubular, when the camshaft is driven in the main direction into each subsequent angular position, said front latch member is retained in the opened position, and a successive latch member is also moved out of said path of displacement of the tubulars and into the opened position by a successive opening cam, thereby allowing the passage of a tubular, and in a final angular position of the camshaft all latch members are retained and locked in the opened position, located out of the path of displacement of tubulars, thereby allowing displacement of the tubulars along the slot.

2. The tubulars storage device according to claim 1, wherein the angular opening extension of the opening cams, associated with the first cam follower of an associated latch member, have a constant radius flank for retaining an opened latch member in the opened position while the camshaft rotates in the main direction to open the successive latch members.

3. The tubulars storage device according to claim 1, further comprising:

a second cam follower on each latch member; and a plurality of closing cams mounted on the camshaft so as to rotate with the camshaft, and which are arranged at spaced apart locations along the camshaft so as to each interact with the second cam follower of an associated latch member, wherein each closing cam has an angular closing extension that, when the drive drives the camshaft in a counter direction, causes the associated latch member to move to the closed position, wherein said plurality of closing cams includes a front closing cam having a smallest angular closing extension and a rear closing cam having a largest angular closing extension and one or more intermediate closing cams between said front and rear closing cam, each of said intermediate closing cams having a greater angular closing extension than a preceding closing cam on the camshaft, and wherein the angular closing extension of each of the closing cams on the camshaft is configured such that:

when the camshaft is driven in the counter direction from the final angular position into a preceding angular position, only a back latch member is released, and is moved by a back closing cam into said path of displacement of the tubulars and into the closed position moving the back latch member into the closed position, blocking the passage of a tubular, when the camshaft is driven in the counter direction into the preceding angular position, said back latch member is retained in the closed position, and a preceding latch member is released by a preceding opening cam to be moved into said path of displacement of the tubulars and out of the closed position by a preceding closing cam, moving the preceding latch member into the closed position, blocking the passage of a tubular, and in the first angular position of the camshaft all latch members are retained and locked in the closed position, extending in the path of displacement of tubulars, thereby prohibiting displacement of the tubulars along the slot.

4. The tubulars storage device according to claim 3, wherein the angular closing extension of the closing cams, associated with the second cam follower of an associated latch member, have a constant radius flank for retaining a closed latch member in the closed position while the camshaft rotates in the counter direction to close the preceding latch members.

5. The tubulars storage device according to claim 3, wherein the closing cam and the opening cam, associated respectively with the first cam follower and the second cam follower of a latch member, each have flanks for guiding the first and second cam followers, the flanks being formed such that each latch member is with the first and second cam followers enclosed between the flank of the opening cam and the flank of the closing cam and no, or only limited, free movement of the latch member is possible at any given position of the camshaft.

6. The tubulars storage device according to claim 3, wherein the opening cams and the closing cams are shaped such that, when the camshaft is driven in the main direction from the final angular position into the first angular position, all latch members are simultaneously released by the opening cams and are moved into the closed position.

7. The tubulars storage device according to claim 3, wherein the first cam follower and the second cam follower, associated with an opening cam and a closing cam respectively, of each latch member are located on opposite lateral sides of the respective latch member.

8. The tubulars storage device according to claim 3, wherein the first cam follower and the second cam follower, associated with an opening cam and a closing cam respectively, of each latch member are located on opposite sides of the pivot axis supporting the respective latch member, such that when the first cam follower is moved in a downward direction, the second cam follower moves in an upward direction and visa versa.

9. The tubulars storage device according to claim 1, wherein the first cam followers are cylindrical shaped extensions of the latch members.

10. The tubulars storage device according to claim 1, wherein the latch members, when in the closed position, extend fully across the slot and wherein on the opposite side of the slot, latch members receiving members are provided for receiving a distal end of an associated latch member, when in the closed position.

11. The tubulars storage device according to claim 1, wherein two latch mechanisms, each comprising latch members with associated camshaft and a latch support structure, are provided, and wherein the latch mechanisms are provided at opposite sides of the slot.

12. The tubulars storage device according to claim 11, wherein latches of the two latch mechanisms are arranged to be active for the same tubular storage positions, such that a tubular, when locked in a storage position, is blocked by a latch of each latch mechanism.

13. The tubulars storage device according to claim 1, wherein the latch members, and the rotary camshaft are held in a latch support structure, to form a latch mechanism.

14. An oil and gas industry drilling structure including the tubulars storage device according to claim 1.

15. The tubulars storage device according to claim 2, further comprising:

a second cam follower on each latch member; and a plurality of closing cams mounted on the camshaft so as to rotate with the camshaft, the plurality of closing cams being arranged at spaced apart locations along the camshaft so as to each interact with the second cam follower of an associated latch member, wherein each closing cam has an angular closing extension that, when the drive drives the camshaft in a counter direction, causes the associated latch member to move to the closed position, wherein said plurality of closing cams includes a front closing cam having a smallest angular closing extension and a rear closing cam having a largest angular closing extension and one or more intermediate closing cams between said front and rear closing cam, each of said intermediate closing cams having a greater angular closing extension than the preceding closing cam on the camshaft, and wherein the angular closing extension of each of the closing cams on the camshaft is configured such that:

when the camshaft is driven in the counter direction from the final angular position into a preceding angular position, only a back latch member is released, and is moved by a back closing cam into said path of displacement of the tubulars and into the closed position moving the back latch member into the closed position, blocking the passage of a tubular, when the camshaft is driven in the counter direction into the preceding angular position, said back latch member is retained in the closed position, and a preceding latch member is released by a preceding opening cam to be moved into said path of displacement of the tubulars and out of the closed position by a preceding closing cam, moving the preceding latch member into the closed position, blocking the passage of a tubular, and in the first angular position of the camshaft all latch members are retained and locked in the closed position, extending in the path of displacement of tubulars, thereby prohibiting displacement of the tubulars along the slot.

16. The tubulars storage device according to claim 4, wherein the closing cam and the opening cam, associated respectively with the first cam follower and the second cam follower of a latch member, each have flanks for guiding the first and second cam followers, which flanks are formed such that each latch member is with the first and second cam followers enclosed between the flank of the opening cam and the flank of the closing cam and no, or only limited, free movement of the latch member is possible at any given position of the camshaft.

17. The tubulars storage device according to claim 4, wherein the opening cams and the closing cams are shaped such that, when the camshaft is driven in the main direction from the final angular position into the first angular position, all latch members are simultaneously released by the opening cams and are moved into the closed position.

18. The tubular storage device according to claim 5, wherein the opening cams and the closing cams are shaped such that, when the camshaft is driven in the main direction from the final angular position into the first angular position, all latch members are simultaneously released by the opening cams and are moved into the closed position.

19. The tubulars storage device according to claim 4, wherein the first cam follower and the second cam follower, associated with an opening cam and a closing cam respectively, of each latch member are located on opposite lateral sides of the respective latch member.

20. The tubulars storage device according to claim 5, wherein the first cam follower and the second cam follower, associated with an opening cam and a closing cam respectively, of each latch member are located on opposite lateral sides of the respective latch member.

* * * * *